United States Patent [19]

Cedergren

[11] 4,245,683

[45] Jan. 20, 1981

[54] PROTECTIVE CONTRIVANCE FOR WOOD SPLITTING MACHINE

[76] Inventor: Karl I. Cedergren, Pl. 3365, 820 94 Hede, Sweden

[21] Appl. No.: 974,564

[22] Filed: Dec. 29, 1978

[30] Foreign Application Priority Data

Jan. 26, 1978 [SE] Sweden ..... 7810006

[51] Int. Cl.[3] ..... B27L 7/00; B27G 21/00

[52] U.S. Cl. ..... 144/194; 144/193 R; 144/251 R

[58] Field of Search ..... 408/710; 144/251 R, 144/251 A, 251 B, 193 R, 194

[56] References Cited

FOREIGN PATENT DOCUMENTS 244536 1/1966 Austria ..... 144/193 R

*Primary Examiner*—W. Donald Bray

*Attorney, Agent, or Firm*—Witherspoon & Hargest

[57] ABSTRACT

A protective contrivance for a wood splitting machine with a rotatable splitting element and a work-table located under the splitting element. The work-table is provided with a table plate which extends towards and under the splitting element. The splitting element is provided with a screw-like front end with a drill point. A drill point protecting element is arranged which may be swung away from a position, in which one portion of the element prevents the drill point from engaging strange objects, and back to the protective position. Such one portion is during the swinging movement also moved axially away from the tip of the rotatable splitting element. Preferably the protective element is biased to the position in which the protective portion is in the protective position and is provided with a recess, the walls of which surround the tip in the protective position. The protective element extends up through a groove in the table plate from the spring biased swivel arm.

5 Claims, 6 Drawing Figures

PROTECTIVE CONTRIVANCE FOR WOOD SPLITTING MACHINE

The present invention relates to a wood splitting machine and more exactly to a protective contrivance for the tip of wood splitting machines of the type with a rotating wedge.

When using wood splitting machines of the type with a rotating splitting wedge, of which at least the fore-end is shaped as a screw with continuously increasing diameter, there is a great danger that the operator gets stuck with his clothes at the tip of the splitting wedge. The splitting wedge is located just above a work-table and the pieces of wood which are to be split are moved along the work-table towards the tip of the rotating splitting wedge. As soon as the tip has come to lie close to the piece of wood it bores its way into the same and the splitting wedge screws itself through the piece of wood which then is cracked due to the increasing thickness of the wedge. The person who holds the piece of wood during this operation does not always reflect upon where the tip will penetrate the piece of wood and it is for that reason apt to happen that the protective glove or any other part of the operator's clothes are present at the spot where the tip penetrates and thus get stuck thereon. It is also, in other situations of work easily done to come into contact with the tip of the splitting wedge with protective gloves, with the wrist-bands of the protective clothes, with a scarf or the like which then get stuck and will be winded onto the tool. The danger for injury will be imminent in such a case.

The threads of the splitting wedge are smooth and there is no danger of anything getting stuck there, but the tip does on the contrary immediately catch objects that come into contact with the same. It has happened that persons who have used machines of this kind have got stuck so badly that not only clothes have been damaged but also fingers have been torn off and other injuries have resulted. Thus, it is an object of the present invention to eliminate the above mentioned risks. This object is attained with a device of the kind indicated in the claims, from which the essential characteristics of the invention also are clear.

Figure 1:
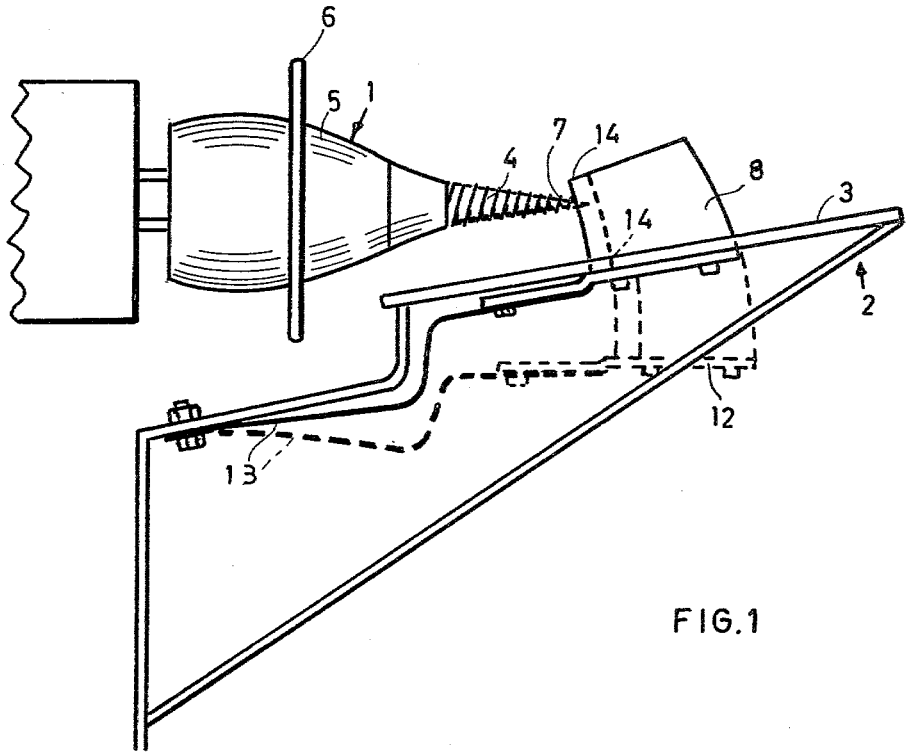
Figure 2:
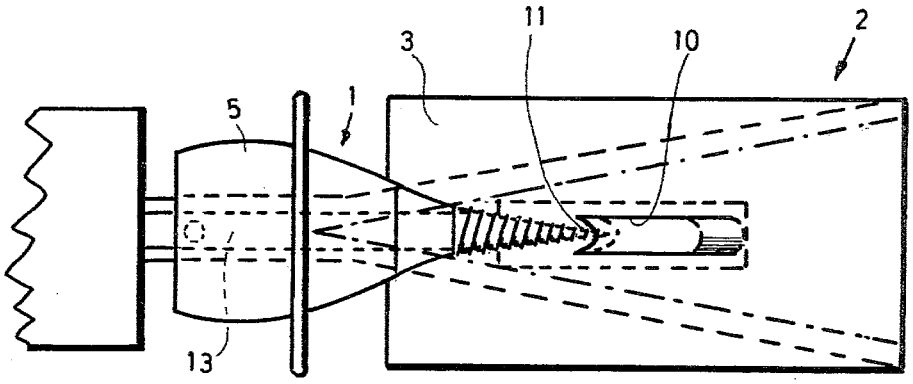
Figure 3:
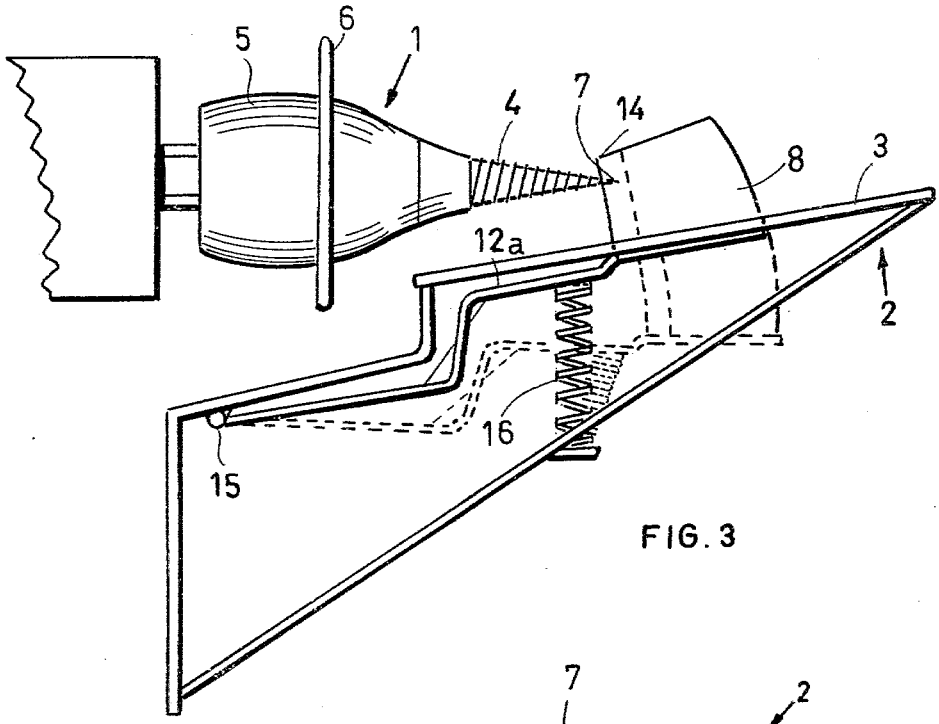
Figure 4:
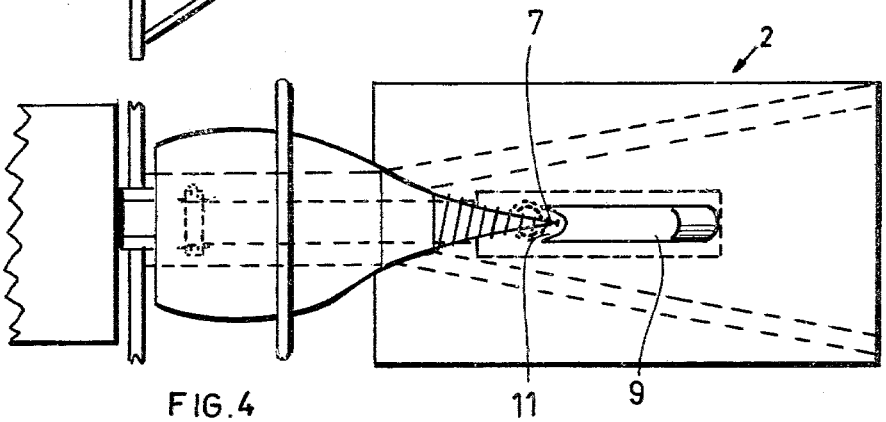
Figure 5:
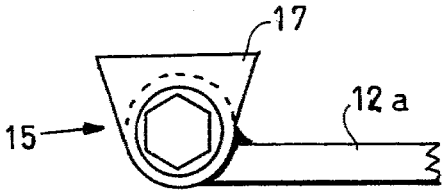
Figure 6:
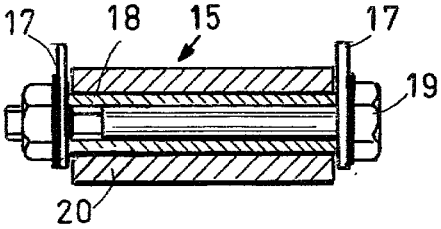

The invention is more clearly described below in connection with the enclosed drawings in which FIG. 1 is a schematic and fragmentary side view of the relevant parts of a wood splitting machine provided with a protective contrivance according to the invention, FIG. 2 is a top view of the parts shown in FIG. 1, FIG. 3 is a view similar to FIG. 1 but shows an alternative embodiment of the protective contrivance according to the invention, FIG. 4 is a top view of the parts shown in FIG. 3, FIG. 5 is a fragmentary view in detail and on an enlarged scale of the bearing arrangement for the swivel arm as viewed from the side, and FIG. 6 is a longitudinal section through the bearing arrangement shown in FIG. 5.

A wood splitting machine of the kind in question consists of a rotatable splitting element 1, which is driven directly or indirectly by a motor. Below the splitting element 1 there is a work-table 2 with a plate 3 which inclines downwardly towards or below the splitting element 1. The plate 3 of the table has essentially the same inclination as the outer part 4 of the splitting element 1 which is provided with a thread of essentially the same kind as a common wood screw. The inner part 5 of the splitting element 1 is preferably provided with a more solid wedge-shape than the outer part 4 and terminates in a circular projection or a ridge 6, which prevents split logs and splinters from entering into the bearing arrangement and the driving apparatus.

Such a wood splitting machine is guite conventional and operates such that the logs which are to be split are placed upright upon the plate 3 of the table and are brought manually into contact with the splitting element 1, the tip 7 of which bores its way into the piece of wood and pulls this towards the inner part 5 of the splitting element 1 due to the thread on the outer part. Due to the increasing diameter of the splitting element 1 the piece of wood will thereby be split. It is also possible to split pieces of wood lying horizontally but in that case there is always a risk that a part of the piece of wood is clamped between the plate 3 of the table and the splitting element 1, which could damage the machine.

The tip 7 itself is the part of the splitting element 1 that has to be protected so that unwanted objects cannot come into contact with the same. It is especially dangerous that the operator of the machine can get stuck on the tip with any parts of his clothes for example the protective gloves, the wrist-bands and the like. When the operator holds his hands around the piece of wood that is to be split he normally holds his hands on the outside of the piece of wood and his thumbs against the back of the piece of wood, seen in the direction of feeding. In that situation it is apt to happen that the tip 7 penetrates the piece of wood quite suddenly and that the operator does not have time to move his thumbs away so that the tip gets stuck in the thumb of one of the protective gloves with the danger of an injury as a result.

This problem is practically completely overcome by the present invention, which consists of a resilient cover 8 which continuously tends to cover the tip 7 of the splitting element 1 as soon as this is not located in the piece of wood that is being split.

In a preferred embodiment the cover 8 consists of a metal piece in the shape of a solid plate which edgeways extends up through a groove 10 in the plate 3 of the table. A V- or U-shaped recess 11 in the edge of the piece 8 facing the tip 7 makes it possible for the piece 8 to surround the tip 7 up to a point past the first or the first few turns of the thread. In the embodiment of the protective contrivance shown in FIGS. 1 and 3 the metal piece 8 is fastened to a horizontal flat bar 12, which in turn is fastened to one end of a plate spring 13, the other end of which is fastened to a portion of the work-table 2 underneath the splitting element 1. In the normal position the spring 13 biasses the cover 8 to the position shown in FIG. 1 in which the tip 7 is covered by the edges of the recess 11 and in which the flat bar 12 rests against the underside of the plate 3.

The cover 8 preferably has a shape such as shown in FIG. 1, with slightly curved front and back edges and with a slightly greater height at the back edge than at the front edge. The inclination of the upper edge is preferably such that when a piece of wood is placed on the cover 8 this is forced downwardly through the groove 10 and will reach a position with its upper edge flush with the plate 3 of the table.

The cover 8 operates in the following manner: When the work is begun the cover 8 is in the position shown in FIG. 1. Then when a piece of wood that is to be split is placed on the plate 3 of the table across the cover 8 the latter is forced away and the piece of wood can be pushed across the plate 3 of the table and can be brought into contact with the tip 7 of the splitting element 1. During this swinging movement that the cover 8 performs its upper corner 14 is moved from its position adjacent or slightly above the tip 7 and partly downwardly until it is flush with the plate 3 of the table but also away from the tip 7. This position is shown with dotted lines in FIG. 1. As soon as the piece of wood during the splitting operation passes the depressed cover 8 this starts to rise due to the spring biasing and during this return movement it is in close contact with the back of the piece of wood. This means that as as soon as the piece of wood is moved so far that the tip 7 penetrates the same the corner 14 is also in a position at least as high as directly opposite the tip 7. If at that time the operator has placed his thumb in the way of the tip 7 the thumb is moved away by the rising cover or it does in any case draw the operators attention to the fact that the thumb is in the risk zone of the tip 7. Moreover there is no likely possibility for other objects to get in the way of the penetrating tip since the tip is covered immediately as it penetrates the piece of wood and if a part of a scarf, a wrist-band or the like should be in close contact with the back of the piece of wood then such an object would be moved away by the rising cover.

This is the basic feature of the present invention, namely that the cover follows the back of the piece of wood that is being split and that the cover is in its place directly opposite the tip 7 of the splitting element 1 not later than at the time when the tip pierces the piece of wood. This function can of course be provided in several alternative and more or less sofisticated ways, but the embodiment of the invention that is shown in FIGS. 1 and 2 is simple, reliable and inexpensive.

In FIGS. 3 to 6 a second embodiment of the invention is shown which differs from the embodiment according to FIGS. 1 and 2 in that a flat bar 12*a* is substituted for the platespring 13 from the cover 8 extending to the a bearing arrangement 15. The spring action is accomplished by means of a coil spring 16, which is inserted between the flat bar 12*a* and an underlying portion of the work-table structure. The function of this embodiment is the same as of the first described embodiment.

The bearing arrangement 15 provides a slightly more stable guiding for the cover 8 during its swinging movement than the plate spring does. The bearing arrangement 15 consists of two lugs 17 which are welded onto the underside of the portion of the work-table 2 positioned below the splitting element 1. A distance element in the shape of a tube 18 is inserted between these lugs 17 and the bolt 19 extends through holes in the lugs 17 and through the tube 18. A larger tube 20 is welded onto the flat bar 12*a* and the distance tube 18 extends through this larger tube. This is a simple and reliable bearing structure.

In certain cases it may be desirable to have a previously known guide under the rotating splitting element which prevents the piece of wood from rotating with the splitting element during the splitting operation. Such a guide may consist of a resilient metal plate which is shaped substantially as the cover according to the invention but which is positioned below the part of the splitting element that is provided with threads and which in its biased position extends up towards the splitting element but which however, with its upper edge, terminates some distance away from this. The split piece of wood passes with one portion on each side of the guide, which at this point prevents these portions from rotating, but if the piece of wood is, however, being split lying down there is no risk of the piece of wood rotating and in this case the guide is forced down into the table.

If such a guide is present the pivot axis of the cover, which consists of the plate spring 13 or the plat bar 12*a*, will either have to be provided with a different bend than the one shown in the drawings and/or it will have to be given a different mounting place at the work-table 2 so that it is out of the way for guide in its path of movement.

In a practical embodiment of the invention designed essentially according to FIG. 1 the corner 14 of the cover 8 was in the initial position a good 5 cm above the plate of the table measured perpendicular to the surface of the table plate 3. In that position the corner 14 of the cover 8 was about 1 cm above the tip 7 of the splitting element 1 which was positioned 4 cm above the plate of the table. The length of the swivel arm 13 was adjusted so that the corner 14 had been moved about 3 cm from the tip 7, measured perpendicular to the surface of the table plate 3, when the upper edge of the cover 8 was flush with the top surface of the table plate 3. This resulted in that the cover started to swing back upwardly while the tip 7 still had about 3 cm left to pierce through the piece of wood.

A certain tolerance for deviations being dependent upon how close to a right angle the piece of wood has been cut and upon the divergent shapes of the pieces of wood has been achieved by making the front edge of the cover 8 slightly concave, i.e. seen in relation to a line that is normal to the surface of the table plate 3 the upper corner 14 of the cover is positioned on the line while its lower corner lies some distance away from said line.

Various changes and modifications can be made without departing from the scope of the invention. Such changes and modifications must however be considered lying within this scope as it has been defined in the appended patent claims.

I claim:

1. A protective contrivance for a wood splitting machine having a rotatable splitting element including a threaded pointed end for penetrating said wood, and a work table including a table plate which extends towards and under said splitting element and including a groove extending through said plate, said protective contrivance comprising a swivel arm one end of which is attached to said work table under said plate, and a cover, said cover being attached to the other end of said swivel arm, said swivel arm including means associated therewith for biasing said swivel arm towards said groove such that said cover extends through said groove and covers said pointed end prior to when said wood has been penetrated by said pointed end during the splitting operation, and just prior to when said pointed end completely penetrates through said wood, said biasing means being overcome by the weight of said wood so that said cover is forced into said groove away from said pointed end at all other times during said splitting operation.

2. A protective contrivance according to claim 1 wherein said biasing means comprises a spring member.

3. A protective contrivance according to claim 2 wherein said spring member comprises a plate spring one end of which is attached to said work table and the other end of which is attached to said swivel arm.

4. A protective contrivance according to claim 1 wherein said cover comprises an upper edge one end of which forms a corner with an adjacent side edge of said cover, said corner being positioned above said pointed end when said cover extends through said groove and covers said pointed end, and being positioned forward of said pointed end, measured in the direction of travel of said wood being split, and recessed in said groove, during the splitting operation.

5. A protective contrivance according to claim 4 wherein said cover includes a pair of opposing sidewalls joined by a top wall, each of said joined sidewalls including said upper edge and said corner, said top wall having a recess extending from said corner of one of said sidewalls to said corner of an opposing sidewall.

* * * * *